US005673914A

United States Patent [19]

Sullivan

[11] Patent Number: 5,673,914

[45] Date of Patent: Oct. 7, 1997

[54] METHOD AND APPARATUS FOR SELECTING LOTTERY NUMBERS WITH WORDS

[76] Inventor: Walter Sullivan, 1319 David Ave., Pacific Grove, Calif. 93950

[21] Appl. No.: 648,754

[22] Filed: May 16, 1996

[51] Int. Cl.[6] ..... A63F 1/18

[52] U.S. Cl. ..... 273/144 R; 273/269; 273/144 B; 273/138.1

[58] Field of Search ..... 273/138 R, 139, 273/142 E, 142 F, 142 G, 144 R, 144 A, 144 B, 148 R, 115, 272, 269

[56] References Cited

U.S. PATENT DOCUMENTS

| | | | |
|---|---|---|---|
| 2,470,310 | 5/1949 | Heyman | 273/269 |
| 3,113,778 | 12/1963 | Silverman | 273/139 |
| 4,884,810 | 12/1989 | Tiyony | 273/144 B |
| 4,902,013 | 2/1990 | Salerno | 273/144 B |
| 5,435,556 | 7/1995 | Rice et al. | 273/142 G |

*Primary Examiner*—William M. Pierce
*Attorney, Agent, or Firm*—LaRiviere, Grubman & Payne

[57] ABSTRACT

A lottery game apparatus has a playing surface including a number of token capturing means. Tokens move across the playing surface under the influence of an external disturbance, and are capturable in a substantially random fashion by the token capturing means. The tokens are marked with integer numbers and the token capturing means are marked with letters of the alphabet, or vice versa. Once the tokens have been captured by the token capturing means, a series of numbers for entering in a lottery can be selected based on a word or combination of letters, the substantially random assignment of the tokens to the token capturing means, and the markings on the tokens and token capturing means.

15 Claims, 3 Drawing Sheets

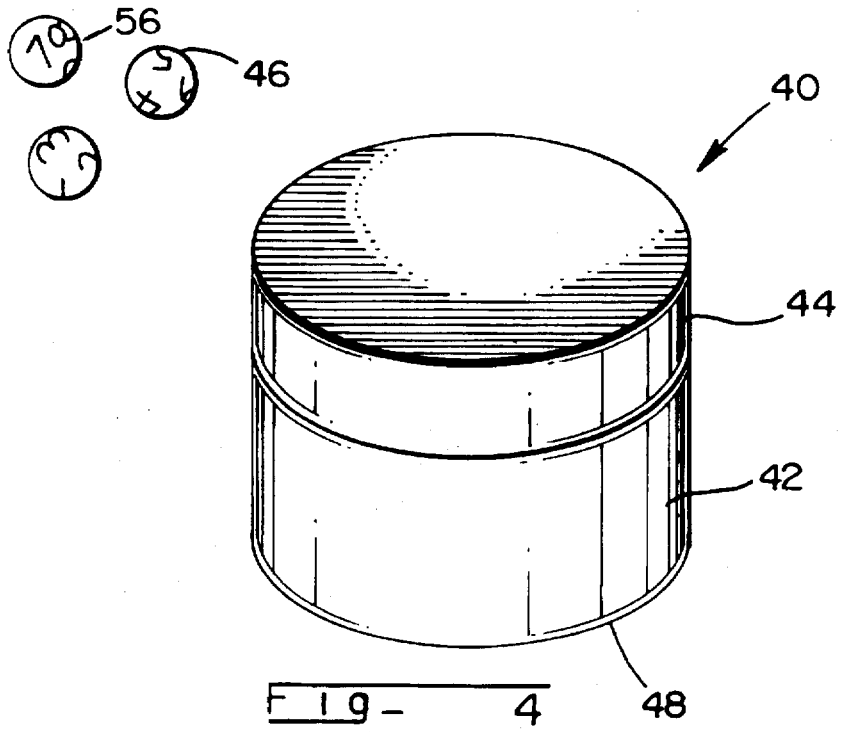
Fig- 4
Fig- 5
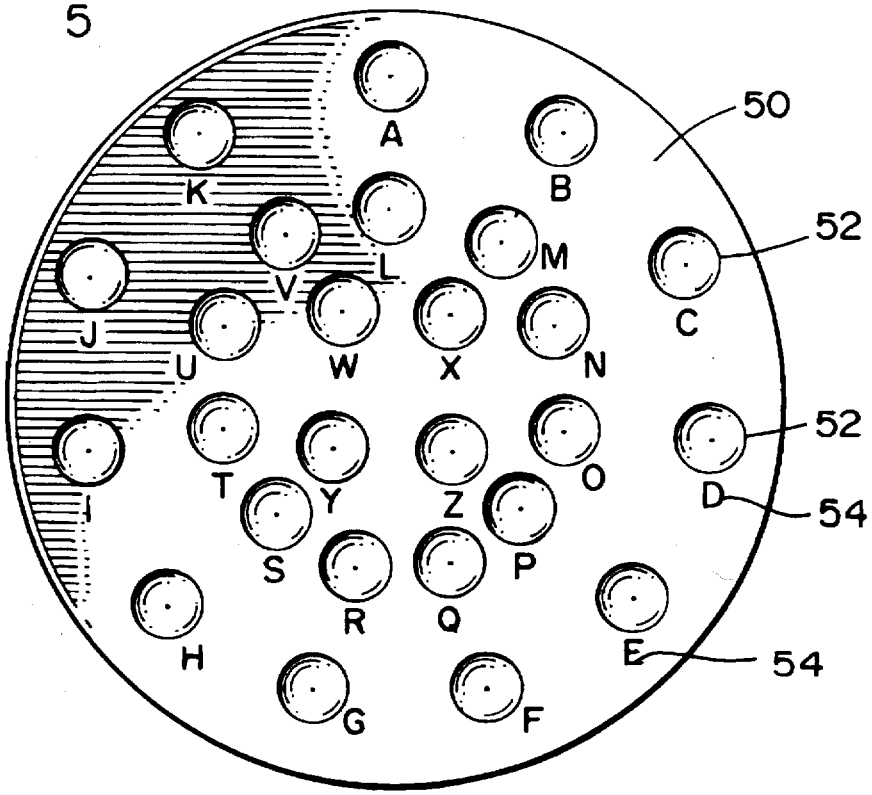

METHOD AND APPARATUS FOR SELECTING LOTTERY NUMBERS WITH WORDS

BACKGROUND OF THE INVENTION

Lotteries are well known games of chance in which a player selects a combination of numbers. If the all or some of these numbers are drawn by the organization running the lottery, the player wins a cash prize. The amount of the prize depends on how many of the player's numbers match the drawn numbers, and in some cases, the order in which the numbers are drawn.

In the California Super Lotto for example, a player chooses a combination of six numbers, each number being in the range from one to fifty-one. Duplicate numbers are not allowed.

Many players choose numbers which have significance in their lives such as birth dates, social security numbers, telephone numbers, and the like. As an alternative to choosing numbers, a player may request that the machine which prints the lottery ticket randomly selects the required numbers.

SUMMARY OF THE INVENTION

According to the invention there is provided a game apparatus comprising a playing surface and a plurality of token capturing means associated with the playing surface. Each token capturing means has associated therewith an alphanumeric character selected from a first set of alphanumeric characters. A plurality of tokens are also provided, and each token has associated therewith an alphanumeric character selected from a second set of alphanumeric characters.

The tokens move across the playing surface under the influence of an external disturbance, and each token is subsequently captured in a token capturing means in a substantially random, or unpredictable, fashion.

A combination of characters in the first set can then be selected according to a predetermined combination of the characters in the second set, or alternatively, a combination of characters in the second set can then be selected according to a predetermined combination of the characters in the first set.

Preferably, the plurality of tokens comprise a plurality of spherical balls, and each ball is marked with a letter of the alphabet.

The plurality of token capturing means preferably comprises a plurality of recesses defined in the playing surface, and each recess is marked with a numeral.

Also according to the invention there is provided a method of selecting a combination of numbers for entering in a lottery. The method comprising the steps of a) providing a first set of alphanumeric characters; b) providing a second set of numbers; c) assigning, in substantially random fashion, alphanumeric characters in the first set to numbers in the second set; and c) selecting a combination of numbers in the second set based on a predetermined combination of the alphanumeric characters in the first set, and based further on the said substantially random assignment of the second set to the first set.

This method and apparatus allows a lottery player to select a lottery number by means of word association. Although the generation of the lottery number itself is substantially random, the player has personalized the lottery number by basing the number on a chosen word or other combination of letters.

BRIEF DESCRIPTION OF THE DRAWINGS

For a fuller understanding of the present invention, reference is made to the accompanying drawings in the following detailed description of the Best Mode of Carrying Out the Present Invention. In the drawings:

FIG. 4 is a perspective view of an alternative embodiment of a lottery game apparatus according to the invention; and, FIG. 5 is a plan view of the playing surface of the lottery game apparatus of FIG. 4.

BEST MODE FOR CARRYING OUT THE INVENTION

Figure 1:
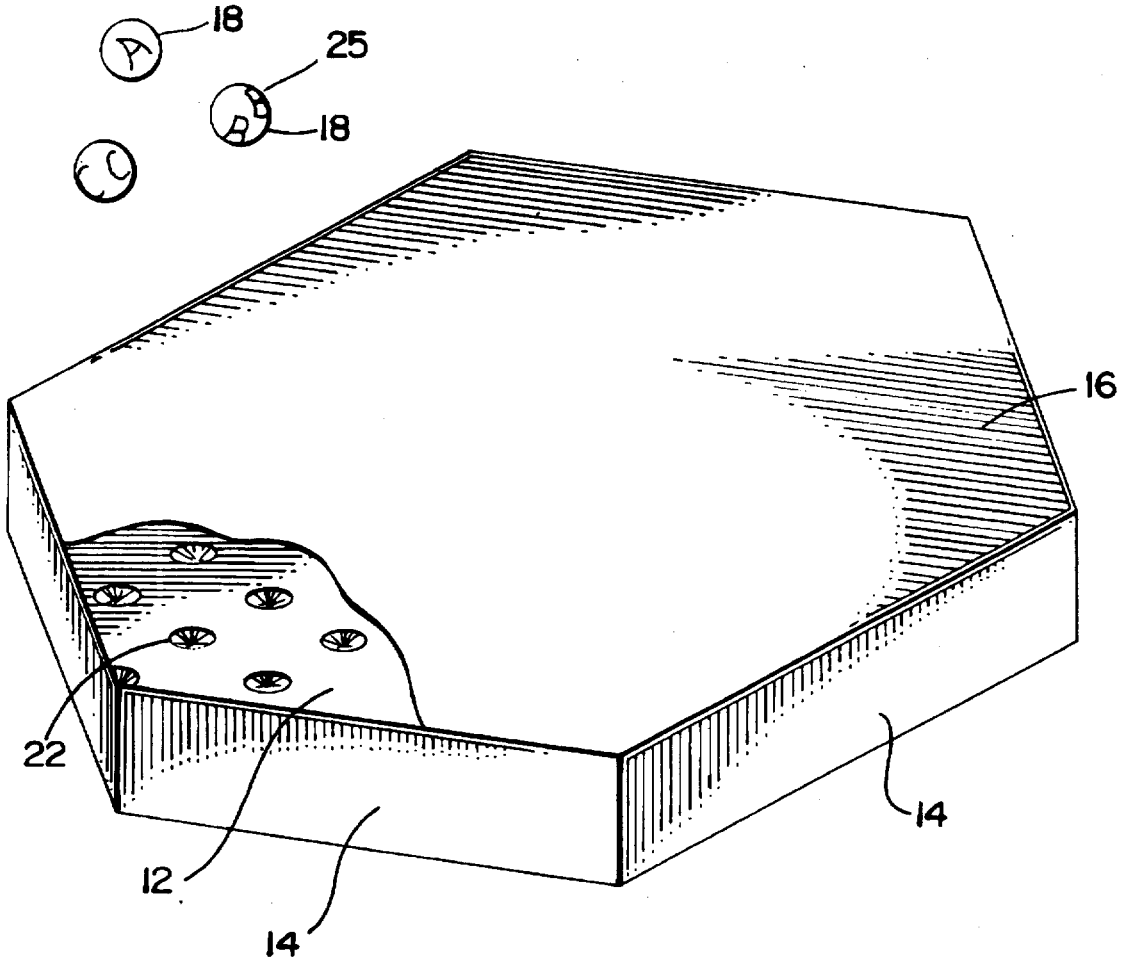
FIG. 1 is a partially cut-away perspective view of the best mode lottery game apparatus according to the invention.

A game apparatus according to the invention, generally indicated by the numeral 10 is shown in FIG. 1. The game apparatus 10 comprises a base 12, upstanding sidewalls 14, a cover 16 and a plurality of game tokens in the form of spherical balls 18.

The base 12, upstanding sidewalls 14 and cover 16 together define a closed container in which the balls 18 are retained.

Figure 2:
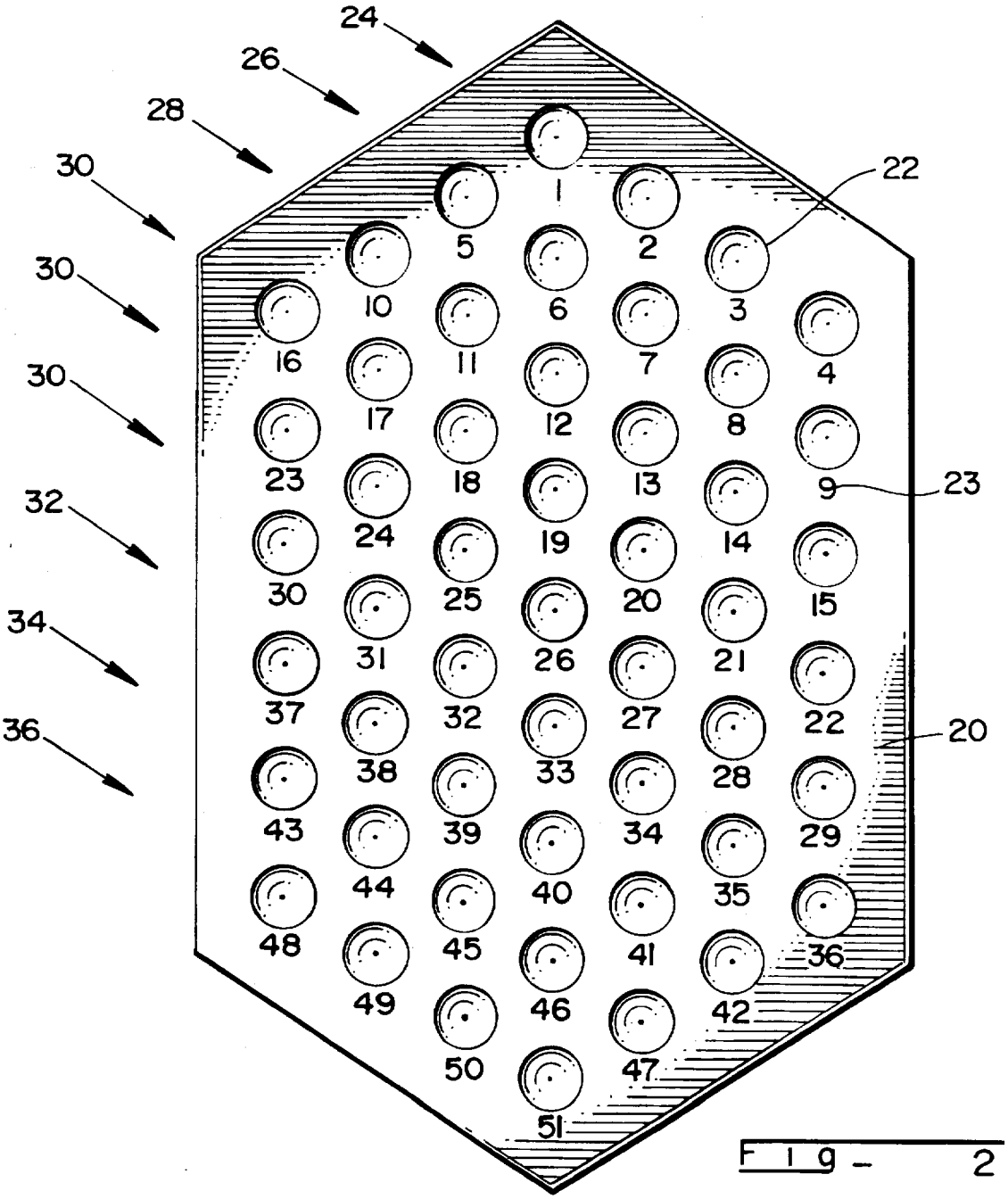
FIG. 2 is a plan view of the playing surface of the lottery game apparatus of FIG. 1.

The upper surface of the base 12 defines a playing surface 20 across which the balls 18 move under the influence of an external disturbance. The playing surface 20, which is illustrated in plan view in FIG. 2., is surrounded by the sidewalls 14 to keep the balls 18 on the playing surface 20.

Figure 3:
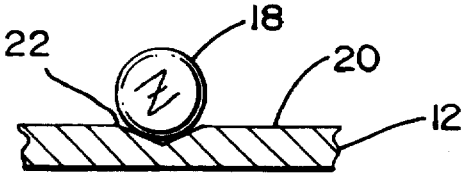
FIG. 3 is a partial cross section through the base of the lottery game apparatus illustrated in FIG. 1.

Defined in the playing surface 20 are a number of token capturing means in the form of recesses 22. Each recess has a diameter of approximately half an inch at the playing surface 20, and tapers in a conical fashion at approximately 30° to a point approximately one eighth of an inch below the playing surface 20 as illustrated in FIG. 3. Each recess 22 is for capturing and retaining a ball 18, and has associated therewith an alphanumeric character from a first set, in this case integer numbers 23.

Each number 23 is marked on the playing surface 20 beneath a corresponding recess 22. The numbers 24 may be of the self adhesive type, or may be printed on or formed in the playing surface 20. In the illustrated embodiment, there are fifty-one recesses 22 numbered from one to fifty-one. This corresponds to all the possible individual numbers that may be used in combination to play the California Super Lotto.

The recesses 22 are arranged in a hexagonal pattern as can be seen in FIG. 1. This pattern provides a compact arrangement of the recesses 22, and allows the odd number of recesses 22 to be accommodated without leaving any of them out of the main area of the pattern. In particular, it can be seen that the hexagonal pattern of recesses is formed of a first row 24 of four recesses, a second row 26 of five recesses, a third row 28 of six recesses, fourth, fifth and sixth rows 30 of seven recesses, a seventh row 32 of six recesses, an eighth row 34 of five recesses, and a ninth 36 row of four recesses.

The balls 18 are approximately half an inch in diameter, and each ball 18 is marked with an alphanumeric character from a second set. In this case, there are twenty-six balls, each being marked with one of the letters 25 of the alphabet from A to Z.

In use, the balls 18 are initially located on the playing surface 20 with at least some of the balls occupying recesses 22. The container is then shaken or tilted, or some other external disturbance is applied to the playing surface 20 or the balls 18. This causes the balls 18 to move across the playing surface 20. When the external disturbance ceases and the playing surface is held substantially level, each ball 18 will then tend to be captured in a recess 22, in a substantially random fashion. Typically, some of the balls 18 will immediately fall into recesses 22, as illustrated in FIG. 3., while additional, slight disturbances of the game apparatus 10 will be required to get all the balls captured in the recesses 22.

When all of the balls 18 have fallen into the recesses 22, it will be appreciated that each of the letters 25 on the balls 18 will have been assigned, in substantially random fashion, to an integer number 23 associated with a recess 22. This permits the user of the game apparatus to select a combination of numbers based on a predetermined combination of letters. For example, if the balls 18 having the letters A; E; L; R; T and W come to rest in the recesses 22 numbered 20; 1; 40; 37; 51 and 21 respectively, the predetermined combination of letters "WALTER" will result in the selection of the numbers 21; 20; 40; 37; 1 and 51. These six numbers can then be entered into the lottery.

As each letter of the alphabet is only represented once in the game apparatus of FIG. 1., if a combination of letters is chosen which has duplicate letters, e.g. "DONALD", the game apparatus 10 will have to be disturbed twice to permit selection of the second letter "D". Alternatively, additional balls 18 could be provided for insertion into the game apparatus 10. In such a case however, the game apparatus would of course have to be provided with an opening or a removable lid as in the embodiment of the invention illustrated in FIG. 3.

An advantage of the game apparatus 10 illustrated in FIG. 1. is that there are almost twice as many recesses 22 as there are balls 18. This ensures that each ball 18 can quickly be captured by a recess 22.

Thus the game apparatus 10 and the method described above can be used to select lottery numbers which will have sentimental value attached to them by the user, while allowing the repeated use of a favorite combination of letters, such as the names of sports teams, loved ones etc., to select the combination of numbers.

A second embodiment of a game apparatus according to the invention is illustrated in FIG. 4. The game apparatus, generally indicated by the numeral 40, comprises a lower portion 42, a removable lid 44, and a number of balls 46. The lower portion 42 includes a base 48 which defines a playing surface 50. The playing surface 50 is illustrated in plan view in FIG. 5. Defined in the playing surface 50 are a number of recesses 52 which have the same general shape and depth as the recesses 22 of the game apparatus of FIG. 1. In the game apparatus 40 however, there are only twenty-six recesses 52 defined in the playing surface 50 and they are arranged in a circular pattern as shown. Each of the recesses 52 has associated therewith an alphanumeric character from a first set, in this case letters of the alphabet 54 from A to Z.

The balls 46 are again approximately half an inch in diameter, and each ball 46 is marked with three alphanumeric characters from a second set. In this case, there are seventeen balls, and each ball 46 is marked with three integer numbers 56 in the range from one to fifty-one. Each of the integer numbers 56 is marked on each ball twice, so that each ball has a total of six markings thereon. This ensures that at least one number 56 should be visible when the ball is resting in a recess 52.

As with the previous embodiment of the invention, the balls 18 are initially located on the playing surface 50 with at least some of the balls occupying recesses 52. The container is then shaken or tilted, the balls 46 are mixed by hand, or some other external disturbance is applied to the playing surface 50 or the balls 46. Each of the balls 46 will then be captured in a recess in a substantially random fashion as before.

In this case however, when all of the balls 46 have fallen into recesses 52, it will be appreciated that the numbers 56 on the balls 46 will have been assigned, in substantially random fashion, to letters 54 of the alphabet associated with recesses 52. This permits the user of the game apparatus to select a combination of numbers on the balls 46 based on a predetermined combination of letters, and based on the substantially random assignment of the balls 46 to the recesses 52.

The game apparatus 40 has the advantage that, because there are less balls 46 and recesses 52 than the game apparatus 10, the game apparatus 40 can be made more compact. Also, if there is a duplicate letter in the chosen combination of letters, there will be three different numbers 56 on the ball 46 occupying the particular recess 52, and it will not be necessary to shake to container again to get an additional number for the combination.

The game apparatus 40 does however have the disadvantage that not all of the letters of the alphabet will be assigned a number at any particular time, and it may therefore be necessary to disturb the game apparatus twice to cover a particular chosen combination of letters.

It will be appreciated that the invention is not limited to the embodiment of the invention described above, and many modifications are possible without departing from the spirit and scope of the invention.

In particular, the size of the game apparatus may be varied to provide, for example, a pocket sized version that will always be handy for avid lottery players.

The number of game tokens and token capturing means may also vary depending on the particular requirements of the local lottery. For example, the California Fantasy 5 lottery requires a combination of five numbers in the range from one to thirty-nine.

The game tokens may be of different colors, and additional tokens for duplicating numbers or letters may be provided.

What is claimed is:

1. A game apparatus for selecting lottery numbers with words, comprising:

a playing surface;

a plurality of token capturing means associated with the playing surface for capturing and retaining tokens, each token capturing means being marked with a numeral; and a plurality of tokens, each token being marked with a letter of the alphabet, each token being movable across the playing surface under the influence of an external disturbance, and each token being capturable by a token capturing means in substantially random fashion, thereby to permit the substantially random selection of a set of numerals based on a predetermined combination of letters of the alphabet.

2. A game apparatus according to claim 1 wherein the plurality of tokens comprise a plurality of spherical balls, the plurality of balls together defining a complete set of the letters of the alphabet from A to Z.

3. A game apparatus according to claim 2 wherein the plurality of token capturing means comprises a plurality of recesses defined in the playing surface, each recess being marked with an integer number.

4. A game apparatus according to claim 3 further comprising sidewalls encircling the playing surface to keep the balls on the playing surface.

5. A game apparatus according to claim 4 wherein the game apparatus comprises a closed container, the playing surface being defined on an interior surface of the container.

6. A game apparatus according to claim 4 wherein the recesses are arranged in a hexagonal pattern.

7. A game apparatus according to claim 6 wherein there are fifty-one recesses marked from one to fifty-one respectively and twenty-six balls marked from A to Z respectively.

8. A method of selecting a combination of numbers for entering in a lottery the method comprising the steps of:

providing a playing surface;

providing a plurality of token capturing means associated with the playing surface for capturing and retaining tokens;

providing a plurality of tokens, each token being movable across the playing surface under the influence of an external disturbance, and each token being capturable by a token capturing means in substantially random fashion;

providing a first set of letters of the alphabet on the tokens;

providing a second set of numbers on the token capturing means;

assigning, in substantially random fashion, tokens to token capturing means; and selecting a combination of numbers in the second set based on a predetermined combination of the letters in the first set and based further on the said substantially random assignment of the tokens to the token capturing means.

9. A game apparatus for selecting lottery numbers with words, comprising:

a playing surface;

a plurality of token capturing means associated with the playing surface for capturing and retaining tokens, each token capturing means being marked with a letter of the alphabet, the plurality of token capturing means together defining a complete set of the letters of the alphabet from A to Z; and a plurality of tokens, each token being marked with a numeral, each token being movable across the playing surface under the influence of an external disturbance, and each token being capturable by a token capturing means in substantially random fashion, thereby to permit the substantially random selection of a set of numerals based on a predetermined combination of letters of the alphabet.

10. A game apparatus according to claim 9 wherein the plurality of tokens comprise a plurality of spherical balls, each ball being marked with a numeral.

11. A game apparatus according to claim 10 wherein the plurality of token capturing means comprises a plurality of recesses defined in the playing surface, each recess being marked with a letter of the alphabet.

12. A game apparatus according to claim 11 further comprising sidewalls encircling the playing surface to keep the balls on the playing surface.

13. A game apparatus according to claim 12 wherein the game apparatus comprises a closed container, the playing surface being defined on an interior surface of the container.

14. A game apparatus according to claim 13 wherein there are twenty-six recesses marked from A to Z respectively, and each ball is marked with more than one integer number.

15. A game apparatus according to claim 13 wherein there are twenty-six recesses marked from A to Z respectively and seventeen balls, each ball being marked with three integer numbers in the range from one to fifty-one.

* * * * *